US005977817A

United States Patent [19]

de la Soujeole

[11] Patent Number: 5,977,817

[45] Date of Patent: Nov. 2, 1999

[54] CURRENT BIASED MODE CONTROL CIRCUIT

[75] Inventor: Axel Alegre de la Soujeole, Scotts Valley, Calif.

[73] Assignee: STMicroelectronics, Inc., Carrollton, Tex.

[21] Appl. No.: 08/961,905

[22] Filed: Oct. 31, 1997

[51] Int. Cl.[6] ..... G05F 1/10

[52] U.S. Cl. ..... 327/538; 327/74; 327/108

[58] Field of Search ..... 327/63, 66, 65, 327/71, 74–76, 77, 108, 538, 531, 535; 323/315, 316

[56] References Cited

U.S. PATENT DOCUMENTS 5,712,581 1/1998 Kaylor ..... 327/74

*Primary Examiner*—Kenneth B. Wells
*Assistant Examiner*—Minh Nguyen
*Attorney, Agent, or Firm*—Theodore E. Galanthay; Lisa K. Jorgenson; Sanford E. Warren

[57] ABSTRACT

A circuit device for selecting operating modes using a single reference pin that uses current rather than voltage in an electronic subsystem. An operating mode is selected by modulating the input bias current over a range of values. A specific range is associated with a given function so that a value of current can assume a parametric input into the subsystem. The circuit has widespread application since current can be modulated faster than voltage and it eliminates the need for multiple voltage reference points.

20 Claims, 2 Drawing Sheets

CURRENT BIASED MODE CONTROL CIRCUIT

FIELD OF THE INVENTION

The present invention relates to a circuit for controlling operating modes in an electronic subsystem and, more specifically, to a device which receives both range and parametric information corresponding to a predetermined function which is selected using a level of current rather than voltage.

BACKGROUND OF THE INVENTION

Conventional methods of controlling operating modes in a circuit include the use of dedicated pins carrying different levels of voltage. For example, a typical printed circuit board may contain 12V, 5V, and 3V DC reference points to permit operation of mixed device logics. Typically, a charge pump, regulated power supply or other similar source of power is used to provide the required array of voltages. Such methods have been incorporated by manufacturers into a wide array of applications.

Multiple voltage reference points are also standard in many microelectronic systems where feature selection is accomplished by placing a HIGH or LOW level signal on a reference pin to indicate a desired operand, function or other selection. For example, the read/write select line on an integrated circuit chip may be toggled by using either a 5V or 0V DC level, one of which is associated with either a read or write function. An operational amplifier switch may be employed to sink and lift the line to either the HIGH or LOW signal, as needed.

An important design aspect is the control time associated with selecting or enabling a mode of operation. For many applications, a voltage level is measured as the differential between any two points on the system plane. Where the differential occurs over a ramping signal source, such as a shunt or stabilizing capacitor, the signal amplitude versus time may have a ramping characteristic. The control time of such a system, thus, becomes a function of the time it takes to ramp to a given triggering voltage within allowed tolerances.

In addition, in many applications a premium is placed on the amount of real estate consumed by the electronics. Today's systems are fitted on smaller and smaller footprints with the underlying devices consuming less space while providing more advanced functions as a result of higher package densities. The use of multiple voltage reference points adds to the space requirements of the overall design.

As such, an object of the present invention is to provide a current biased mode control circuit for selecting operating modes, features and functions in an electronic subsystem that has a relatively fast control time as compared with prior art methods and designs.

It is another object of the present invention to provide such a circuit with a variable current source having a range of values wherein each range is associated with a predefined mode of operation.

It is another object of the present invention to provide such a circuit with at least two mode switching devices for selecting associated modes of operation.

Other objects, features and advantages of the invention shall be apparent to those of ordinary skill in the art upon reference to the following detailed description taken in conjunction with the accompanying drawings.

SUMMARY OF THE INVENTION

The present invention may be incorporated into any electronic system wherein more than a single voltage reference is typically used to control modes of operation. In one embodiment, a mode of operation is selected by modulating the bias current over a range of values. A range of values may be associated with a given function such that a value of current can assume a parametric input. For example, in a digital preamplifier, write/read operations may be enabled depending on the value of the bias current and whether that value falls into a predefined range for a read or write operation.

BRIEF DESCRIPTION OF THE DRAWINGS

In the figures.

Corresponding numerals in the figures refer to corresponding parts unless otherwise indicated.

DETAILED DESCRIPTION OF THE PREFERRED EMBODIMENTS

The detailed description is presented in conjunction with a mode control circuit suitable for selecting the read/write functionality of a digital signal preamplifier. It should be understood, however, that the inventive aspects of the present invention may have utility in a host of applications where a variable source of current may be applied to select an operable mode of functionality.

Figure 1A:
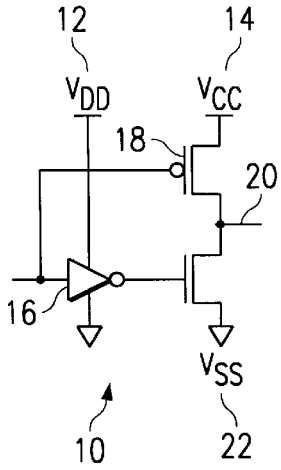
FIG. 1a (PRIOR ART)
FIG. 1*a* is a circuit diagram of a prior art device using multiple threshold voltage references Vdd, Vcc and Vss.

In FIG. 1, an Integrated Circuit ("IC") chip of the type commonly found in the industry is shown and denoted generally as 10. IC chip 10 uses two positive supply voltages Vdd 12 and Vcc 14. Most of the internal circuitry including inverter 16, operates from the Vdd supply 12 while the upper output transistor 18 operates from Vcc 14. Thus, output 20 swings between a value of Vcc 14 and Vss 22. In practice, Vdd is set at 12V, while Vcc is set at 5V and Vss held at ground providing a device with three voltage reference points.

Figure 1B:
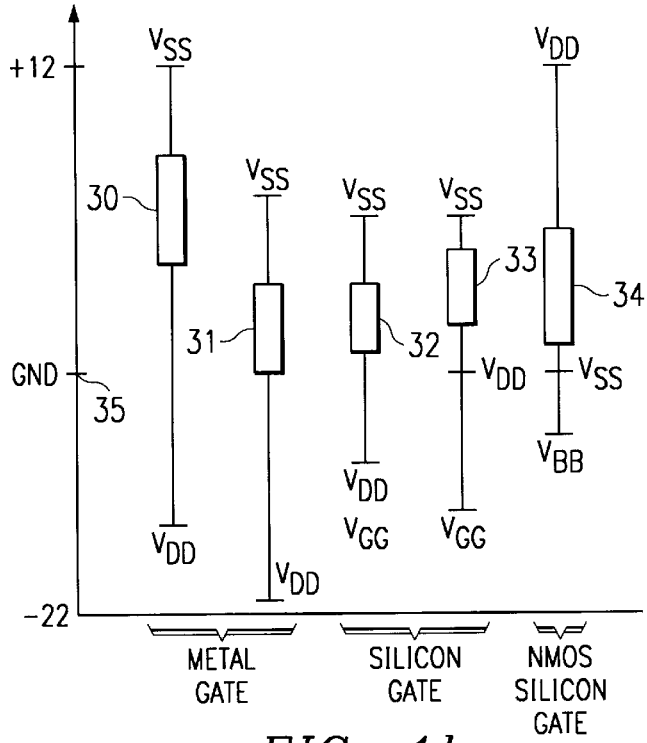
FIG. 1b (PRIOR ART)
FIG. 1*b* summarizes the various supply voltages for various prior art logic devices of the type well known in the industry.

The use of multiple voltage reference points Vdd 12, Vcc 14 and Vss 22 in a single IC chip 10 is further illustrated in FIG. 1*b* wherein the supply voltages $V_{ss}$ 22 for a number of different circuits and resulting input HIGH and LOW thresholds (indicated by the rectangles 30, 31, 32, 33 and 34 on the voltage scale) for various industry standard MOS LSI circuit devices are shown. As illustrated the thresholds 30, 31, 32, 33 and 34 vary from a positive 12V to a negative 22V with respect to the ground "GND" reference 35.

Such variances in thresholds among the different families of devices present design considerations for most practical applications. Consequently, applications with mixed devices on the same system board or integrated circuit chip must be able to provide the different thresholds to ensure device level operability. The result is the use of additional circuitry to provide the necessary voltage reference points. Such design considerations are well known to those of ordinary skill in the art.

Figure 2:
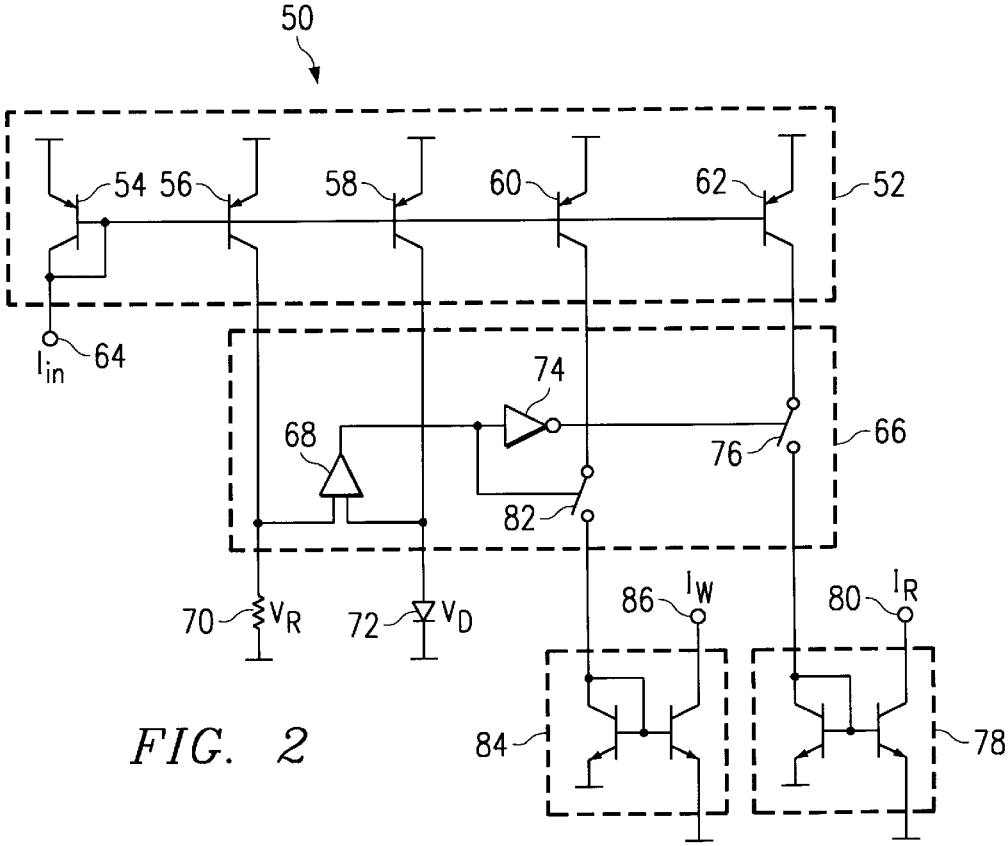
FIG. 2 is a block diagram of a bias mode control circuit device according to the invention.

Turning to FIG. 2, a block diagram of a current biased mode control device according to the invention is shown and denoted generally as 50. The chief objective of the circuit is to selectively and conditionally replicate input bias current 64 so that circuit 50 can be used to indicate multiple functions such as read, write or sleep. In one embodiment, the amplitude and flow of bias currents 64 is controlled from an external source, which may comprise a programmable current supply or similar variable current means.

As shown, the current biased mode control circuit of diagram 50 employs an array of transistors 54, 56, 58, 60 and 62 forming a current mirror 52. Current mirror 52 effectively reproduces bias current 64 at various points on the circuit 50. Below current mirror 52 is a unique display of control logic 66. The control logic 66 is configured to switch replicated input bias current 64 from current mirror 52 to current sources 78 and 84 based on the magnitude of the reference voltage applied to the inputs of comparator 68. The input reference voltages to comparator 68 are produced from the voltage drop across resistor 70, ($V_R$) and diode 72, ($V_D$) created by input bias current 64.

Resistor 70 and diode 72 provide reference voltages VR and VD respectively for comparator 68. If the voltage drop across resistor 70 ($V_R$) is less than the voltage drop across diode 72 ($V_D$) comparator 68 outputs a low signal. The low signal is inverted by inverter 74, thus activating switch 76.

Activated switch 76 provides continuity for input bias current 64 to current source 78. Current source 78 then reproduces the input current to the enabling output pin ($I_R$) 80 with a possible gain factor $B_{78}$. However, if $V_D$ is less than $V_R$, the comparator 68 activates switch 82, which then provides a replication of input current 64 at current source 84. Current source 84 then reproduces the input bias current 64 to the write output enable pin ($I_w$) 86 with a possible gain factor $B_{84}$. The circuit 50 also provides a sleep function when the input bias current 64 is equal to zero thus disabling both outputs 80 and 86.

Figure 3:
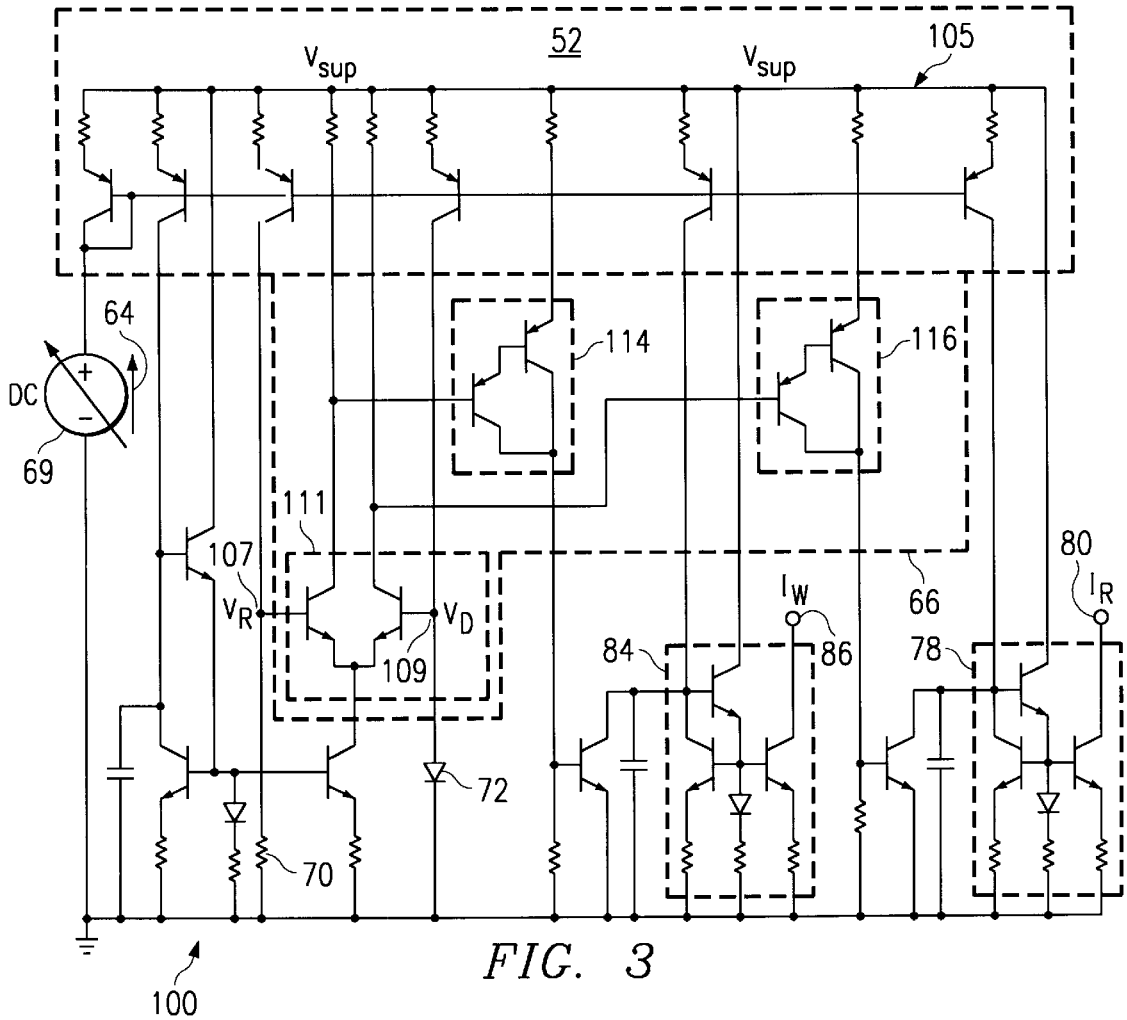
FIG. 3 is a circuit diagram of a practical bias mode control circuit according to one embodiment of the invention.

With reference to FIG. 3, a circuit diagram of a preamplifier circuit using a bias mode control circuit is shown and denoted generally as 100. A single supply voltage 105 (Vsup) is used as a power rail for the entire circuit 100. A variable current generator 69 generates the bias current 64 within a specified range of current values.

Circuit 100 effectively comprises the current mirror 52, the control logic circuit 66 and the current sources 78 and 84 of FIG. 2 in discrete form. As shown,, an array of transistors below supply rail Vsup 105 form th current mirror 52. The input terminals 107 and 109 are input leads to the transistor circuit 111 that forms part of the comparator circuit 68 of FIG. 2. Likewise, the transistor circuits 116 and 114 provide the switches 76 and 82 which are used to selectively place the replicated input bias current 64 to the appropriate output 80 and 86. Circuit sections 78 and 84 function as current sources used to replicate input bias current at read and write terminals 80 and 86, respectively.

For example, according to one embodiment, values on the order of 5–60 milliamps for bias current 64 are used with a range of 5–16 milliamps defined for a read operation and 30– 60 milliamps for a write operation. Thus, two distinct ranges are defined with each range associated with a predetermined function. Within each range, the precise value of bias current 64 can be resolved to determine the adjustment or optimization of the associated read or write function. This arrangement uses one less pin compared to prior art methods and decreases control time in the system, since current is being controlled rather than voltage.

As shown, complementary arranged voltage terminals 107 and 109 have voltage $V_R$ and $V_D$ drops, respectively. Current generator 69 is coupled to voltage terminal 107 and terminal 109 via the current mirror 52 with the bias current 64 flowing through either terminal depending on its range. For example, when the bias current 64 is equal to zero, both output currents $I_w$ (i.e. for write) 86 and $I_R$ (i.e. for read) 80 are zero and the preamplifier circuit 100 is disabled. This is also the sleep mode function equivalent of circuit 100.

When the bias current 64 is greater than zero and $V_D$ at terminal 109 is less than $V_R$ at terminal 107, then $I_{TR}$ 80 is ON and $I_w$ is OFF, where $I_R$ equals $B_{78}$ * bias current 64. In this situation, the read mode of circuit 100 is selected. Similarly, when $V_R$ at terminal 107 is less than VD at terminal 109, then $I_w$ is ON and $I_R$ is OFF selecting the write mode of the circuit, where $I_w$ equals $B_{84}$ * bias current 64. Thus, by choosing different current ranges for the bias current 64, different modes of functioning can be selected.

Figure 4:
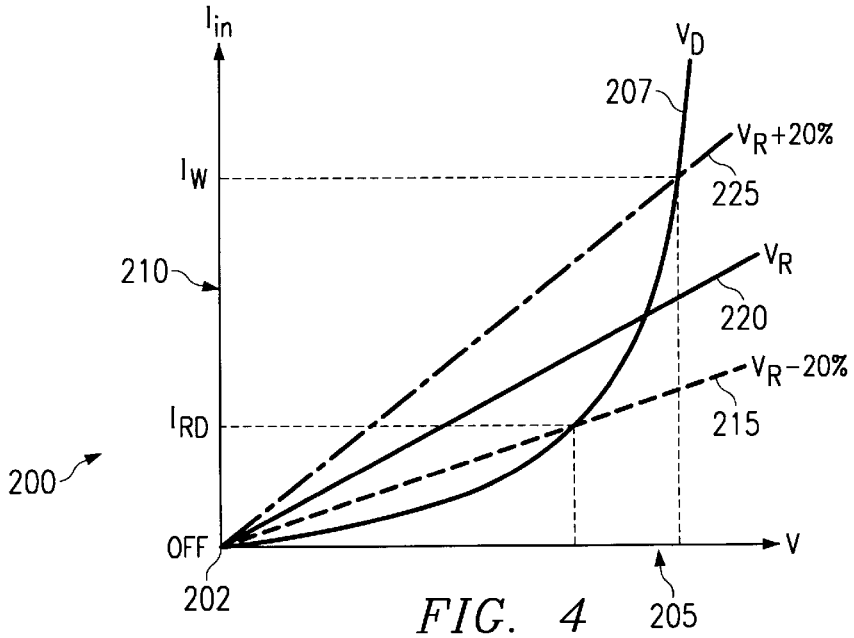
FIG. 4 illustrates the I-V characteristics of a read/write mode control device implemented using the circuit of FIG. 3.

Turning to FIG. 4, the voltage (V) 250 versus current (I) 210 characteristics of a bias mode control circuit 50 according to the invention are illustrated in chart 200. Chart 200 shows the I/V characteristic curve 207 of reference diode 72 and the different I/V characteristic curves 215, 220 and 225 of the reference resistor 70 connected at the input of comparator 68. Sleep mode is represented at point 202 and occurs when the bias current 64 is at zero. From there, chart 200 tracks the voltage across the reference diode 72 along exponential curve 207. Due to process variations absolute values of reference resistor 70 varies plus or minus 20%. The exponential curve 207 illustrates the responsiveness of the diode with proportionate amount of voltage input. Chart 200 provides the characteristics of the discrete components, which may be used in relation with comparator 68. The characteristic curve provides information relative to the trip points of the comparator 68, which falls within a range of values.

While the invention has been described in reference to illustrative embodiments, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. A current biased mode control circuit comprising:

a first current terminal;

a first mode switch operably coupled between said first current terminal and a current source;

a second current terminal;

a second mode switch operably coupled between said second current terminal and said current source;

a first voltage terminal coupled to said current source, said first voltage terminal having a first voltage to current characteristic based on the current output from said current source;

a second voltage terminal coupled to said current source, said second voltage terminal having a second voltage to current characteristic based on the current output from said current source; and a comparator coupled to said first and second voltage terminals and said first mode and second mode switches, said comparator configured to turn said first mode switch ON when the voltage amplitude at said first voltage terminal is less than the voltage amplitude at said second voltage terminal and to turn said second mode switch ON when the voltage amplitude at said second voltage terminal is less than the voltage amplitude at said first voltage terminal.

2. The circuit according to claim 1 wherein the amplitude of current flowing through both said first current terminal and said second current terminal is controlled from an external source.

3. The circuit according to claim 1 wherein said current source provides a current swing between two distinct current ranges.

4. The circuit according to claim 3 wherein the value of current through said first current terminal is functionally related to one of said distinct current ranges when the value of current through said second current terminal is zero.

5. The circuit according to claim 3 wherein the value of current through said second current terminal is functionally related to one of said distinct current ranges when the value of current through said first current terminal is zero.

6. The circuit according to claim 1 wherein the range of current flowing through said first current terminal is independent of the range of current flowing through said second current terminal.

7. The circuit according to claim 1 wherein said first and second mode voltage terminals are configured in a complementary arrangement to each other.

8. The circuit according to claim 1 further comprising a gain stage interposed between said first mode switch and said first current terminal for amplifying the value of current supplied by said current source.

9. A current biased mode control circuit comprising:

an input terminal for receiving a variable current;

a first output terminal and a second output terminal;

a current mirror circuit connected to said input terminal and to a control circuit at two or more control input connections, said current mirror circuit configured to reproduce said variable current at each of said two or more control input connections;

said control circuit configured to use said variable current reproduced at each of said two or more control input connections to produce an ON signal at said first output terminal when said variable current is within a first current range and to produce said ON signal at said second output terminal when said variable current is within a second current range.

10. The current biased control device as recited in claim 9, further comprising a controlled circuit connected to said first output terminal and said second output terminal such that two or more functions of said controlled circuit are controlled by said control circuit.

11. The current biased control device as recited in claim 10, wherein said two or more functions comprise putting said controlled circuit into a write mode or a read mode.

12. The current biased control device as recited in claim 10, wherein said first and second output terminals, said current mirror circuit, said control circuit and said controlled circuit are located within a single integrated circuit.

13. The current biased control device as recited in claim 9, wherein said control circuit is further configured to produce an OFF signal at said first output terminal and at said second output terminal when said variable current is substantially zero.

14. The current biased control device as recited in claim 9, wherein:

said two or more control input connections comprise a first connection, a second connection, a third connection and a fourth connection; and said control circuit further comprises a resistor connected between said first connection and a ground, a diode connected between said second connection and said ground, a first switch connected between said third connection and said first output terminal, a second switch connected between said fourth connection and said second output terminal, and a comparator circuit connected to said first connection, said second connection, said first switch and said second switch such that said comparator circuit turns said first switch ON and said second switch OFF when said variable current is within a first current range and turns said first switch OFF and said second switch ON when said variable current is within a second current range.

15. The current biased control device as recited in claim 14, wherein said control circuit further comprises:

a first gain circuit connected between said first switch and said first output terminal such that a specific current is provided at said first output terminal when said first switch is turned ON; and a second gain circuit connected between said second switch and said second output terminal such that said specific current is provided at said second output terminal when said second switch is turned ON.

16. A method of controlling a first function and a second function of a controlled circuit using a single input terminal, the method comprising the steps of:

receiving a input current at said single input terminal;

creating a first voltage drop by applying said input current to a first circuit having a first voltage to current characteristic;

creating a second voltage drop by applying said input current to a second circuit having a second voltage to current characteristic; and comparing said first voltage drop with said second voltage drop and activating said first function of said controlled circuit when said first voltage drop is less than said second voltage drop and activating said second function of said controlled circuit when said second voltage drop is less than said first voltage drop.

17. The method as recited in claim 16, wherein said first function puts said controlled circuit into a write mode and said second function puts said controlled circuit into a read mode.

18. The method as recited in claim 16, wherein said step of comparing said first voltage drop with said second voltage drop further comprises activating a third function when both said first voltage drop and said second voltage drop are substantially zero.

19. The method as recited in claim 18, where said third function puts said controlled circuit into a sleep mode.

20. The method as recited in claim 16, wherein said first circuit comprises a resistor and said second circuit comprises a diode.

* * * * *